US010857396B2

(12) United States Patent
Hayes

(10) Patent No.: US 10,857,396 B2
(45) Date of Patent: Dec. 8, 2020

(54) EMERGENCY AIR SUPPLY SYSTEM AND METHOD

(71) Applicant: Adam Hayes, Fairmont, WV (US)

(72) Inventor: Adam Hayes, Fairmont, WV (US)

( * ) Notice: Subject to any disclaimer, the term of this patent is extended or adjusted under 35 U.S.C. 154(b) by 292 days.

(21) Appl. No.: 16/101,648

(22) Filed: Aug. 13, 2018

(65) Prior Publication Data

US 2019/0282838 A1 Sep. 19, 2019

Related U.S. Application Data

(60) Provisional application No. 62/642,731, filed on Mar. 14, 2018.

(51) Int. Cl.

| | |
|---|---|
| ***A62B 7/02*** | (2006.01) |
| ***A62B 9/06*** | (2006.01) |
| ***A62B 25/00*** | (2006.01) |

(52) U.S. Cl.

CPC ..... *A62B 7/02* (2013.01); *A62B 9/06* (2013.01); *A62B 25/00* (2013.01)

(58) Field of Classification Search

CPC .... A62B 7/00; A62B 7/02; A62B 7/12; A62B 9/025; A62B 9/06; A62B 18/02; A62B 25/00; A62B 5/00; A62B 7/04; A62B 7/08; A62B 7/10; A62B 7/14; A62B 9/00; A62B 9/006; A62B 9/04; A62B 18/00; A62B 18/08; A61M 2205/58; A61M 2205/581; A61M 2205/583; A61M 2205/8206; A61M 16/0075; A61M 16/0084; A61M 2205/07–075

USPC ..... 128/201.12, 202.22, 202.27, 204.18, 128/204.28, 205.13, 205.17, 205.22, 128/205.24, 205.25, 206.21, 206.23, 128/206.24, 206.27–206.29

See application file for complete search history.

(56) References Cited

U.S. PATENT DOCUMENTS

| | | | | | |
|---|---|---|---|---|---|
| 2,087,119 | A * | 7/1937 | Rosenow | A62B 7/02 | 128/205.25 |
| 3,370,585 | A | 2/1968 | O'neill | | |
| 4,119,097 | A * | 10/1978 | Spector | A62B 7/02 | 128/205.17 |
| 4,373,522 | A * | 2/1983 | Zien | A62B 15/00 | 128/200.24 |
| 4,440,163 | A * | 4/1984 | Spergel | A62B 18/04 | 128/205.13 |
| 4,640,278 | A * | 2/1987 | Barry | A62B 7/00 | 128/206.12 |
| 4,710,756 | A * | 12/1987 | Thornburg | G08B 17/113 | 128/201.23 |

(Continued)

*Primary Examiner* — Rachel T Sippel
*Assistant Examiner* — Benjamin M. Kusiak
(74) *Attorney, Agent, or Firm* — Boudwin Intellectual Property; Daniel Boudwin

(57) ABSTRACT

An emergency air supply system and method for delivering breathable air to an individual in need thereof. The system includes a wall mounted housing that contains an air tank, an inflatable bag, and an ocular respiratory mask. The air tank is removably connected to the inflatable bag, and the inflatable bag is connected to the ocular respiratory mask. During use, the inflatable bag is inflated by an air supply of the air tank, the inflatable bag is removed from the air tank, and the ocular respiratory mask, which remains connected to the inflatable bag, is worn by the individual in need of breathable air.

15 Claims, 7 Drawing Sheets

(56) References Cited

U.S. PATENT DOCUMENTS

| | | | | | |
|---|---|---|---|---|---|
| 4,793,342 | A * | 12/1988 | Haber | A62B 9/04 | 128/202.27 |
| 4,805,608 | A * | 2/1989 | Eckstein | A62B 19/00 | 128/202.26 |
| 4,862,147 | A * | 8/1989 | Thomas | G08B 17/00 | 340/628 |
| 4,974,584 | A | 12/1990 | Goodnoe | | |
| 5,524,616 | A | 6/1996 | Smith et al. | | |
| 5,655,525 | A * | 8/1997 | Orr | A62B 25/00 | 128/201.22 |
| 5,816,243 | A * | 10/1998 | Georgiou | A62B 17/04 | 128/205.24 |
| 6,530,374 | B1 * | 3/2003 | Ferraro | A62B 9/06 | 128/206.21 |
| 7,497,216 | B2 | 3/2009 | Forsyth et al. | | |
| 2003/0024533 | A1 | 2/2003 | Sniadach | | |
| 2008/0236589 | A1 * | 10/2008 | Bronson | A62B 7/02 | 128/206.24 |
| 2012/0103335 | A1 * | 5/2012 | Zeevi | A62B 99/00 | 128/204.18 |
| 2012/0240935 | A1 * | 9/2012 | Johansen | A61M 16/0045 | 128/205.17 |
| 2014/0060545 | A1 * | 3/2014 | Hollm | A62B 7/14 | 128/206.27 |
| 2014/0128676 | A1 * | 5/2014 | Law | A61M 16/06 | 600/114 |
| 2014/0137869 | A1 * | 5/2014 | Schrader | A62B 9/04 | 128/205.21 |
| 2014/0283837 | A1 * | 9/2014 | Turrisi | A61M 16/1005 | 128/205.13 |
| 2015/0083133 | A1 * | 3/2015 | Dunn | A61M 39/223 | 128/204.21 |
| 2017/0021204 | A1 * | 1/2017 | Baek | A62B 25/00 | |
| 2018/0001121 | A1 * | 1/2018 | Sibuet | A62B 25/005 | |

* cited by examiner

EMERGENCY AIR SUPPLY SYSTEM AND METHOD

CROSS REFERENCE TO RELATED APPLICATIONS

This application claims priority under 35 U.S.C. § 119(e) to U.S. Provisional Application No. 62/642,731 filed on Mar. 14, 2018. The above identified patent application is incorporated by reference herein in its entirety to provide continuity of disclosure.

BACKGROUND OF THE INVENTION

The present invention relates to an emergency air supply system and method.

Many fire related deaths occur due to smoke inhalation. An individual who is in a burning structure is often exposed to smoke while attempting to escape a fire. This can result in exposure of the individual to carbon monoxide, among other poisonous substances, which can cause significant danger to the individual. Smoke inhalation symptoms include lung damage, confusion, and drowsiness, which can impede the attempt to escape the fire. Additionally, it can be difficult to navigate a smoke-filled area, as smoke can irritate an individual's eyes, which can impede the individual's vision. Existing solutions for escaping fire, such as crawling or crouching during escape, may decrease smoke inhalation, but can also prolong the escape.

Therefore, there is a need in the art for an improved solution for providing both breathable air and eye protection to an individual attempting to escape an emergency, such as a fire. The present invention addresses this unmet need.

Devices have been disclosed in the art that relate to emergency air supply systems. These include devices that have been patented and published in patent application publications. These devices are often inconvenient to use. In view of the devices disclosed in the art, it is submitted that there is a need in the art for an improvement to existing systems for emergency air supply. In view of the present disclosure, it is submitted that the present invention substantially diverges in structural and functional elements from devices in the art, and the present invention substantially fulfills an unmet need in the art.

SUMMARY OF THE INVENTION

In view of the disadvantages inherent in the known types of emergency air supply systems, the present invention provides a new and improved emergency air supply system, wherein the same can be utilized by an individual in an emergency, such as a fire.

It is therefore an object of the present invention to provide an emergency air supply system.

It is another object of the present invention to provide a method of providing air to an individual in an emergency, using the emergency air supply system.

Another object of the present invention is to provide an emergency air supply system that may be readily manufactured from materials that permit relative economy and are commensurate with durability.

Generally, the invention provides an emergency air supply system, having a stationary component and a mobile component. During an emergency, the mobile component, which includes an ocular respiratory mask having an inflatable bag connected to an air supply of the stationary component, is inflated with air from the air supply, and then removed from the stationary component for use during escape. In this manner, a weight of the mobile component is minimized, thereby enabling one or more individuals, having any of a range of physical abilities, to utilize the emergency air supply system when escaping the emergency.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
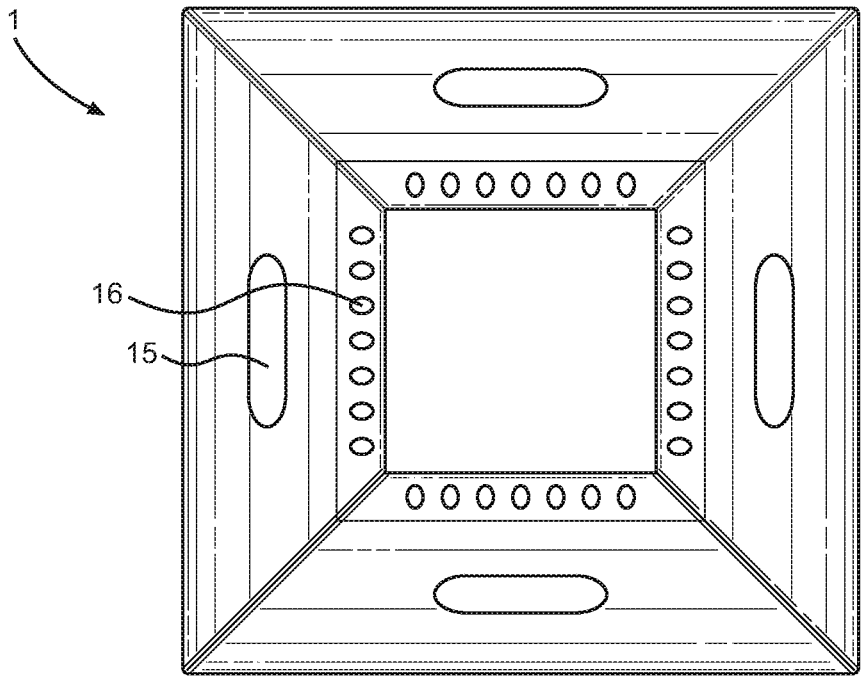
FIG. 1 depicts a front perspective view of an exemplary emergency air supply system, with a housing in a closed position.

Reference is made herein to the attached drawings. Like reference numerals are used throughout the drawings to depict like or similar elements of the invention. The figures are intended for representative purposes only and should not be considered limiting in any respect.

Reference is now made to the drawings, which depict one or more exemplary embodiments of the invention.

Figure 2:
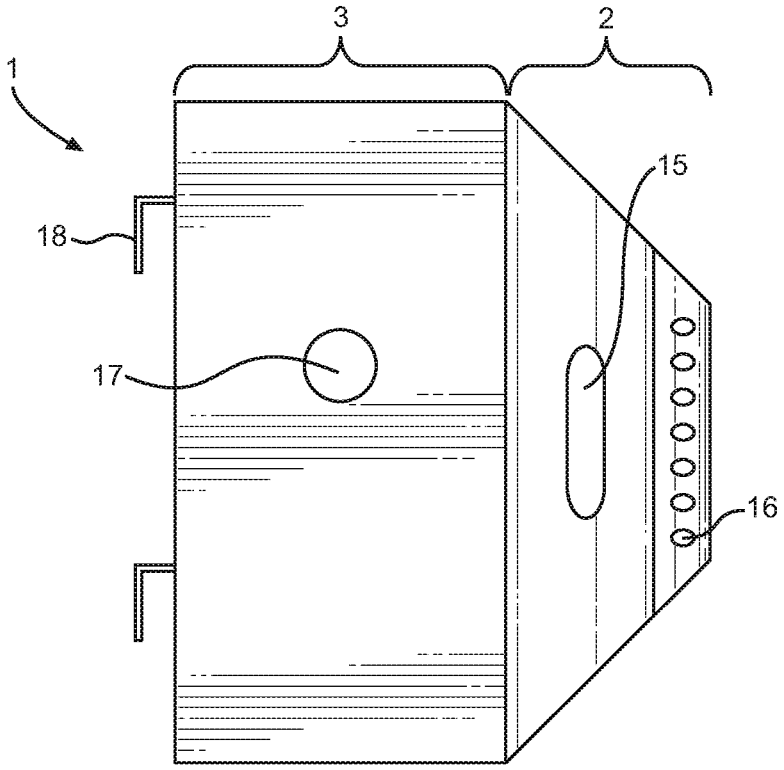
FIG. 2 depicts a right side perspective view of the exemplary emergency air supply system, with the housing in the closed position.

Referring now to FIGS. 1 and 2, there are depicted a front perspective view (FIG. 1) and a right side perspective view (FIG. 2) of an exemplary emergency air supply system, with a housing in a closed position. The emergency air supply system 1 includes a forward housing cover 2 attached to a rearward housing body 3. The forward housing cover 2 includes a plurality of apertures 16, thereby fluidly connecting an interior of the housing to an exterior of the housing. The forward housing cover 2 includes a plurality of lights 15, configured to illuminate upon a detection of an emergency. A right side of the rearward housing body 3 includes an air pressure gauge 17, flush with the right side of the rearward housing body 3, configured to enable an individual to monitor a pressure of an air supply of the emergency air supply system 1 displayed by the air pressure gauge 17. In some embodiments, the air pressure gauge 17 may be viewed through a transparent window, built into and flush with the right side of the rearward housing body 3. In addition, a rear side of the rearward housing body 3 includes one or more wall mounts 18, configured to attach the housing of the emergency air supply system 1 to a wall or another vertical structure for storage and use. The forward housing cover 2 has a depth that is large enough to contain and secure the contents of the housing in the closed position, and is configured to be able to be opened completely, such that the forward housing cover 2 may form a compact, 180 degree angle between a forward surface of the rearward housing body 3 and the forward housing cover 2 when in a fully opened position. In this manner, the emergency air supply system 1 is relatively compact, and has a relatively low profile for placement of the emergency air supply system 1 near doorways, hallways, or stairways of an interior of a building structure, without disrupting a flow of foot traffic during the emergency.

Figure 3:
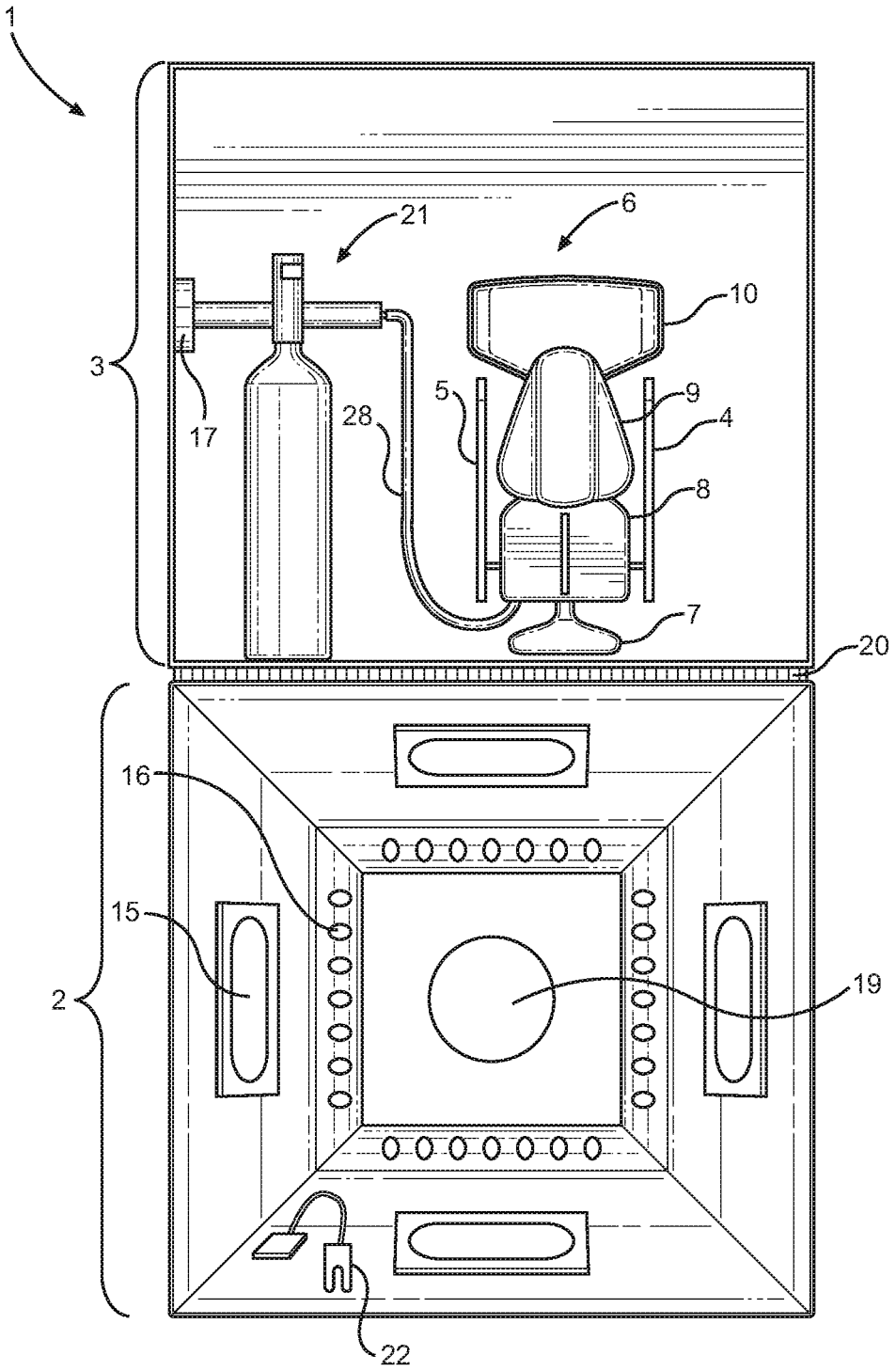
FIG. 3 depicts a front perspective view of the exemplary emergency air supply system, with the housing in an open position, and with a fluid communication between an air supply and an inflatable bag opened to initiate an inflation of the inflatable bag, as occurs upon a placement of the housing in the open position.

Referring now to FIG. 3, there is depicted a front perspective view of the exemplary emergency air supply system, with the housing in an open position, and with a fluid communication between an air supply and an inflatable bag opened to initiate an inflation of the inflatable bag, as occurs upon a placement of the housing in the open position. The emergency air supply system 1 is depicted with the housing in the open position, such that the forward housing cover 2 is hingedly opened, revealing the interior of the housing. The forward housing cover 2 is hingedly attached to the rearward housing body 3 by a hinge 20, disposed on or near a lower front edge of the rearward housing body 3. In this manner, the forward housing cover 2 may be easily opened with an assist of a gravitational force acting on the forward housing cover 2. The forward housing cover 2 includes a smoke detector 19 disposed therein, configured to detect the emergency, such as a fire, by the fluid communication between the interior of the housing and the exterior of the housing enabled by the plurality of apertures 16. In this manner, the emergency air supply system 1 is configured to independently detect the emergency. The air pressure gauge 17 is flush against the right side of the rearward housing body 3, thereby facilitating an audit of a pressure of the air supply.

In some embodiments, the smoke detector 19 is operably connected to the plurality of lights 15, thereby configuring the plurality of lights 15 to illuminate upon the detection of the emergency by the smoke detector 19. In this manner, the emergency air supply system 1 is configured to independently detect the emergency, and to alert an individual nearby of the emergency. In some embodiments, a combination of the illuminated plurality of lights 15 and a noise of the smoke detector 19 upon the detection of the emergency provides both visual and audio warnings to alert the individual nearby that escaping the emergency may require a use of the emergency air supply system 1.

An interior of the rearward housing body 3 includes an air supply in actuatable fluid communication with an inflatable bag 7 of an ocular respiratory mask 6. The air supply is fluidly connected to the inflatable bag 7 by a flexible tube 28, and is actuatably connected to the flexible tube 28 by an air supply valve assembly 21. Actuation of the air supply valve assembly 21 from a closed position to an open position includes a removal of an air supply valve assembly clip 22 from the air supply valve assembly 21, as occurs upon an opening of the forward housing cover 2, as explained elsewhere herein.

A feature of the present invention includes a left roller wheel track 4, extending from a lower left portion of a rear surface of the interior of the rearward housing body 3 in an upward and forward direction, and a right roller wheel track 5, extending from a lower right portion of the rear surface of the interior of the rearward housing body 3 in the upward and forward direction. The roller wheel tracks (4, 5) are configured to removably accept a pair of roller wheels attached to a left and a right side of a tube assembly housing 8. Upon actuation of the air supply valve assembly 21 from the closed position to the open position, the roller wheel tracks (4, 5) guide the roller wheels in the upward and forward direction during inflation of the inflatable bag 7 of the respiratory mask 6, thereby configuring the ocular respiratory mask for removal from the housing and use in the emergency, as explained elsewhere herein.

The ocular respiratory mask 6 includes the inflatable bag 7, a tube assembly having the tube assembly housing 8, a respiratory cover 9, and a transparent ocular cover 10. The ocular respiratory mask 6 includes a lightweight and compact form factor, thereby enabling use by individuals having different degrees of physical ability.

Figure 4:
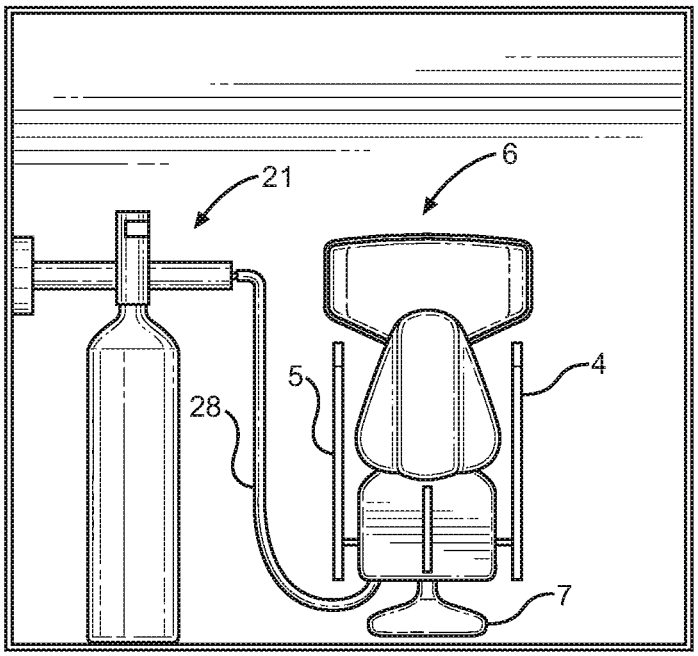
FIG. 4 depicts a front perspective view of a rearward housing body of the exemplary emergency air supply system, with the housing in the open position, and with the fluid communication between the air supply and the inflatable bag opened to initiate the inflation of the inflatable bag.
Figure 5:
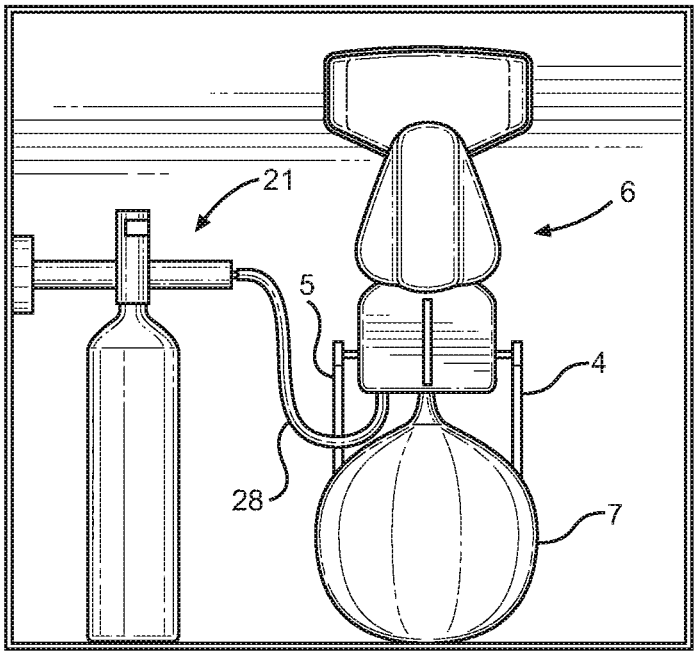
FIG. 5 depicts a front perspective view of the rearward housing body of the exemplary emergency air supply system, with the housing in the open position, and with the fluid communication between the air supply and the inflatable bag opened to complete the inflation of the inflatable bag.

Referring now to FIGS. 4 and 5, there are depicted two front perspective views of a rearward housing body of the exemplary emergency air supply system, with the housing in the open position, and with the fluid communication between the air supply and the inflatable bag opened to initiate (FIG. 4) and complete (FIG. 5) the inflation of the inflatable bag. Removal of the air supply valve assembly clip 22 from the air supply valve assembly 21 fluidly connects the air supply to the inflatable bag 7 by the flexible tube 28. Upon the air supply being connected to the inflatable bag 7, a pressurized air of the air supply is directed through the tube assembly into the inflatable bag 7, thereby inflating the inflatable bag 7 with the pressurized air. Inflation of the inflatable bag 7 by the air supply causes the inflatable bag 7 to expand, thereby exerting a downward force from a lower surface of the inflatable bag to a lower surface of the interior of the rearward housing body, thereby sliding the left roller wheel upward and forward along the left roller wheel track 4, and sliding the right roller wheel upward and forward along the right roller wheel track 5. In this manner, the ocular respiratory mask 6 is configured to be removed from the housing and used in the emergency.

The left roller wheel track 4 and the right roller wheel track 5 are configured to lift and present the ocular respiratory mask 6 upon inflation of the inflatable bag 7 by the air supply. In this manner, the individual needing to use the emergency air supply system does not need to perform any unnecessary or complicated tasks or steps to obtain breathable air in the emergency.

Figure 6:
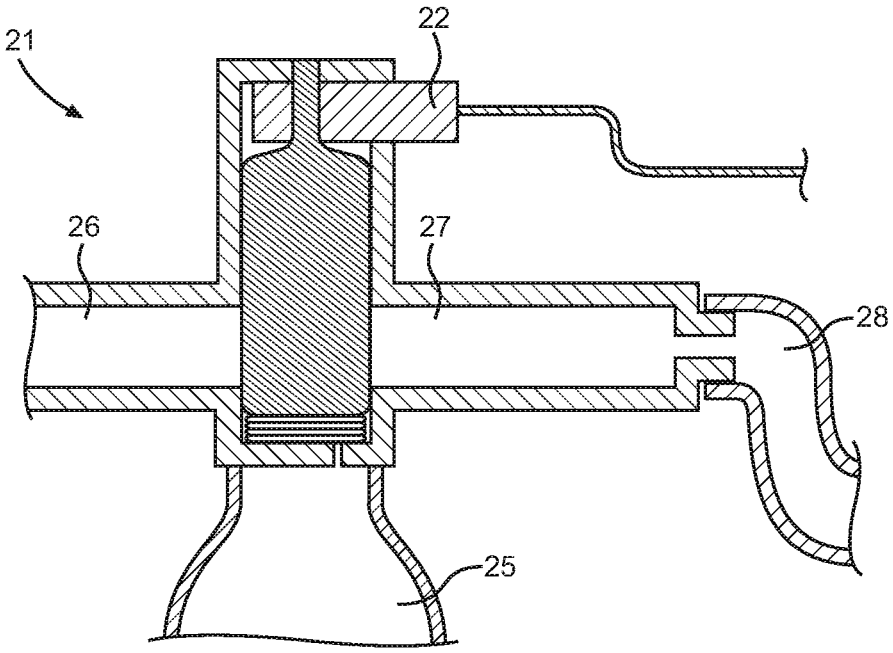
FIG. 6 depicts a cross section view of an air supply valve assembly of the exemplary emergency air supply system, with the fluid communication between the air supply and the inflatable bag closed to prevent the inflation of the inflatable bag.
Figure 7:
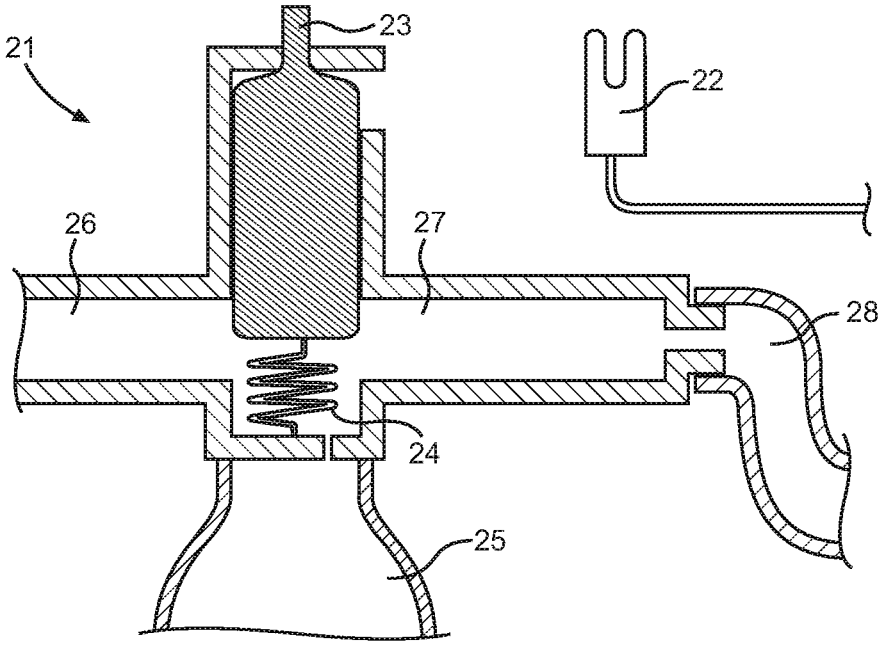
FIG. 7 depicts a cross section view of the air supply valve assembly of the exemplary emergency air supply system, with the fluid communication between the air supply and the inflatable bag opened to initiate and complete the inflation of the inflatable bag.

Referring now to FIGS. 6 and 7, there are depicted two cross section views of an air supply valve assembly of the exemplary emergency air supply system, with the fluid communication between the air supply and the inflatable bag closed to prevent the inflation of the inflatable bag (FIG. 6) and opened to initiate and complete the inflation of the inflatable bag (FIG. 7). The air supply valve assembly 21 controls the fluid connection between an air tank 25, a left channel 26 leading to the air pressure gauge, and a right channel 27 leading to the flexible tube 28.

FIG. 6 depicts the air supply valve assembly 21 in a downward or closed position, such that a pressurized air of the air tank 25 is prevented from passing into the left channel 26 and the right channel 27 by a cylindrical seal 23. The cylindrical seal 23 is biased toward an upward or open position by a cylindrical seal spring 24. In the downward or closed position, the cylindrical seal 23 is prevented from moving into the upward or open position by the air supply valve assembly clip 22, which includes a body having a shape resembling the letter "C," configured to fit around a thin upper protrusion of the cylindrical seal 23 and engage with an upper stop of the air supply valve assembly. In this manner, the air supply valve assembly 21 includes a potential mechanical energy that is released upon removal of the air supply valve assembly clip 22 during the opening of the forward housing cover 2, thereby minimizing an effort of the individual preparing the system for use.

FIG. 7 depicts the air supply valve assembly 21 in the upward or open position, such that the pressurized air of the air tank 25 is allowed to pass into the left channel 26 and the right channel 27 by the cylindrical seal 23. Removal of the air supply valve assembly clip 22 releases the pressurized air of the air tank 25 into the rest of the air supply valve assembly 21.

The air supply valve assembly clip 22 is operably connected to the forward housing cover 2. In this manner, opening the forward housing cover 2 pulls the air supply valve assembly clip 22, removing the air supply valve assembly clip 22 from the air supply valve assembly 21 and actuating the actuatable fluid communication between the air supply and the inflatable bag. In this manner, the individual in the emergency does not need to perform any unnecessary or complicated tasks or steps to obtain breathable air.

In some embodiments, the air supply valve assembly 21 is configured to provide a continuous source of pressurized air from the air tank 25 to the left channel 26, and actuation of the air supply valve assembly 21 directs pressurized air from the air tank 25 to the right channel 27. In this manner, the pressure of the pressurized air from the air tank 25 may be continuously monitored and displayed without the need to actuate the air supply valve assembly 21. In some embodiments, the air supply valve assembly 21 is designed for a one-time use of the air supply, and the air supply cannot be reused once the air supply valve assembly 21 is actuated.

In some embodiments, a regulator is included in the emergency air supply system, such that the regulator is configured to control a pressure output from the air supply valve assembly 21. Particularly, the pressure output from the air supply valve assembly 21 should not exceed a maximum pressure capacity of the inflatable bag, to avoid popping or destroying the inflatable bag during use in the emergency. Particularly, the pressure output from the air supply valve assembly 21 is configured to not exceed the maximum pressure capacity of the inflatable bag. The emergency air supply system is configured to deliver the pressurized air from the air supply to the inflatable bag, such that when the inflatable bag is fully inflated, the system remains intact before use by the user.

Figure 8:
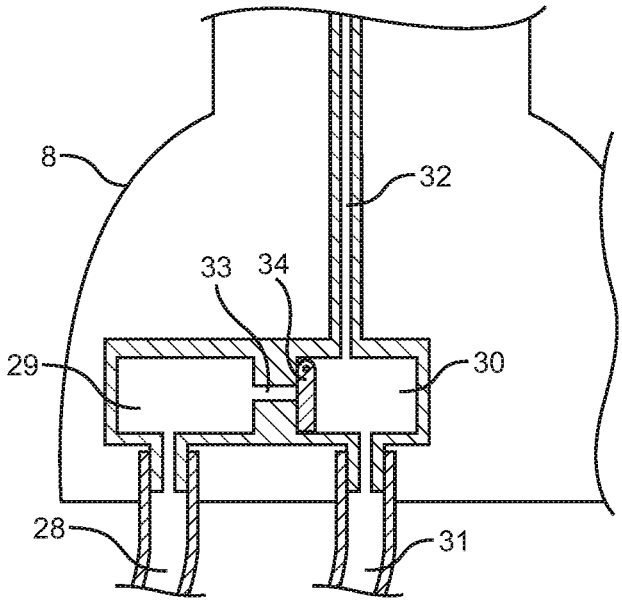
FIG. 8 depicts a cross section view of a tube assembly of the exemplary emergency air supply system, depicting a first position of a biased air flap, which occurs if the fluid communication between the air supply and the inflatable bag is closed.
Figure 9:
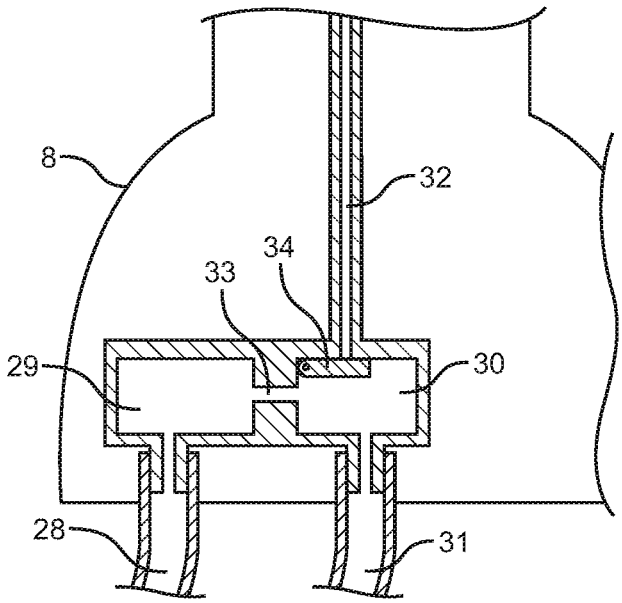
FIG. 9 depicts a cross section view of the tube assembly of the exemplary emergency air supply system, depicting a second position of the biased air flap, which occurs if the fluid communication between the air supply and the inflatable bag is opened.

Referring now to FIGS. 8 and 9, there are depicted two cross section views of a tube assembly of the exemplary emergency air supply system, depicting a first position of a biased air flap, which occurs if the fluid communication between the air supply and the inflatable bag is closed (FIG. 8), and a second position of the biased air flap, which occurs if the fluid communication between the air supply and the inflatable bag is opened (FIG. 9). The tube assembly is contained within the tube assembly housing 8. The tube assembly includes an inlet chamber 29, fluidly connected to the flexible tube 28 and an intermediate channel 33. In an absence of the pressurized air in the inlet chamber 29, the intermediate channel 33 is closed off from a main chamber 30 by a biased air flap 34, which is biased to be positioned vertically, as depicted in FIG. 8. Upon an introduction of the pressurized air to the inlet chamber 29 by the air supply upstream of the flexible tube 28, the bias of the biased air flap 34 is overcome, and the biased air flap 34 pivots horizontally, as depicted in FIG. 9.

The pressurized air passes from the inlet chamber 29 through the intermediate channel 33, and into the main chamber 30, where it is directed to an upper portion 31 of the inflatable bag, and into the inflatable bag for inflation. Upon inflation of the inflatable bag, a pressure of the main chamber 30 is greater than a pressure of a mouthpiece tube 32 and the bias of the biased air flap 34, thereby keeping the biased air flap 34 in a horizontal position, as depicted in FIG. 9. In this manner, the emergency air supply system is configured to remain inflated until removal of the ocular respiratory mask from the roller wheel tracks and the rearward housing body, which severs the actuatable fluid communication between the air supply and the tube assembly by removal of the flexible tube 28 from the tube assembly and allows the biased air flap 34 to return to a vertical position, as depicted in FIG. 8. In this manner, the pressurized air of the air supply or a pressurized air of the inflatable bag is prevented from escaping through the mouthpiece tube 32 until the ocular respiratory mask is removed and the flexible tube 28 is removed from the tube assembly. Upon removal of the ocular respiratory mask from the roller wheel tracks and the rearward housing body, the flexible tube 28 is removed from the tube assembly, and a fluid communication between the inflatable bag and the mouthpiece tube 32 is reinstated, now with a pressure differential between the inflatable bag and the mouthpiece tube 32. In this manner, the pressurized air of the inflatable bag is directed to the mouthpiece tube 32, and onward to a mouthpiece of the ocular respiratory mask, thereby configuring the emergency air supply system for use.

In some embodiments, a force may be applied (e.g., a squeezing or pinching force, manually applied by one or more digits of a user of the ocular respiratory mask) at or near the upper portion 31 of the inflatable bag after inflation of the inflatable bag and removal of the ocular respiratory mask. In this manner, the pressurized air within the inflatable bag is preserved when applying the ocular respiratory mask to a face of the user, or when traversing one or more sections of the building that do not require the use of the ocular respiratory mask.

Figure 10:
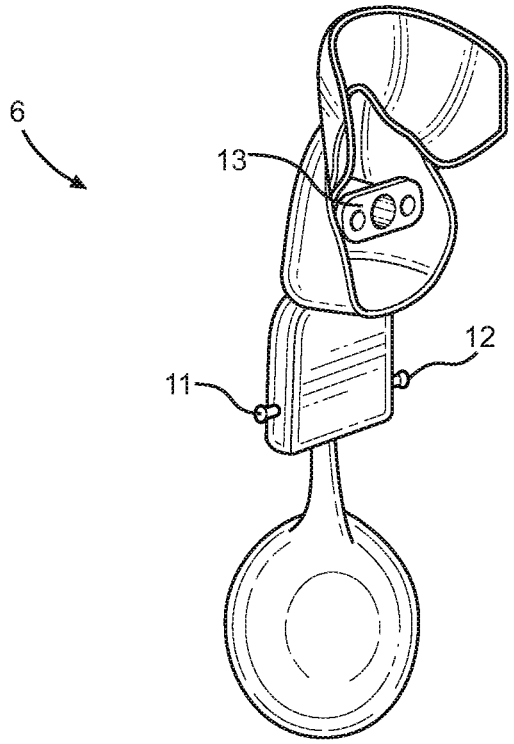
FIG. 10 depicts a rear left perspective view of an ocular respiratory mask of the exemplary emergency air supply system, after inflation of the inflatable bag and removal of the ocular respiratory mask from the rearward housing body.

Referring now to FIG. 10, there is depicted a rear left perspective view of an ocular respiratory mask of the exemplary emergency air supply system, after inflation of the inflatable bag and removal of the ocular respiratory mask from the rearward housing body. The ocular respiratory mask 6 includes the mouthpiece 13, positioned in and protruding from an interior of the respiratory cover, in fluid communication with the inflatable bag. In addition, a left roller wheel 11 and a right roller wheel 12 are attached to the housing of the tube assembly, and are configured to be slidably disposed in the left roller wheel track and the right roller wheel track, respectively, as described elsewhere herein.

Generally, the mouthpiece 13 is configured to be bitten down to secure the ocular respiratory mask to the face of the user. A flow of the pressurized air from the inflatable bag through the mouthpiece 13 may be controlled by the squeezing or pinching force, manually applied by one or more digits of the user of the ocular respiratory mask, or may be controlled by blocking the flow by placement of a tongue of the user over an aperture of the mouthpiece 13, as would be understood by the user. In this manner, both hands of the user may be available for opening doors, removing debris, or navigating obstacles while escaping the emergency.

Figure 11:
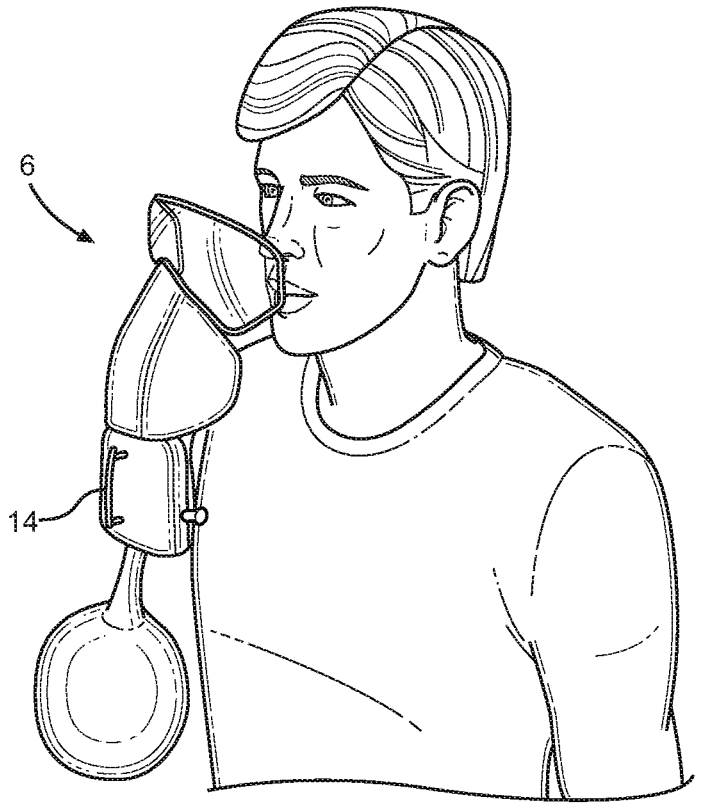
FIG. 11 depicts a front left perspective view of the ocular respiratory mask of the exemplary emergency air supply system, after inflation of the inflatable bag and removal of the ocular respiratory mask from the rearward housing body, being applied to a face of a user.

Referring now to FIG. 11, there is depicted a front left perspective view of the ocular respiratory mask of the exemplary emergency air supply system, after inflation of the inflatable bag and removal of the ocular respiratory mask from the rearward housing body, being applied to a face of a user. The ocular respiratory mask 6 includes the handle 14, placed on the housing of the tube assembly, to facilitate placement of the ocular respiratory mask 6 onto the face of the user, or for securing the mouthpiece inside a mouth of the user. In this manner, the ocular respiratory mask 6 may be secured to the face of the user without requiring the user to bite down on the mouthpiece, and may also facilitate application of the ocular respiratory mask to the face of the user by another individual.

Figure 12:
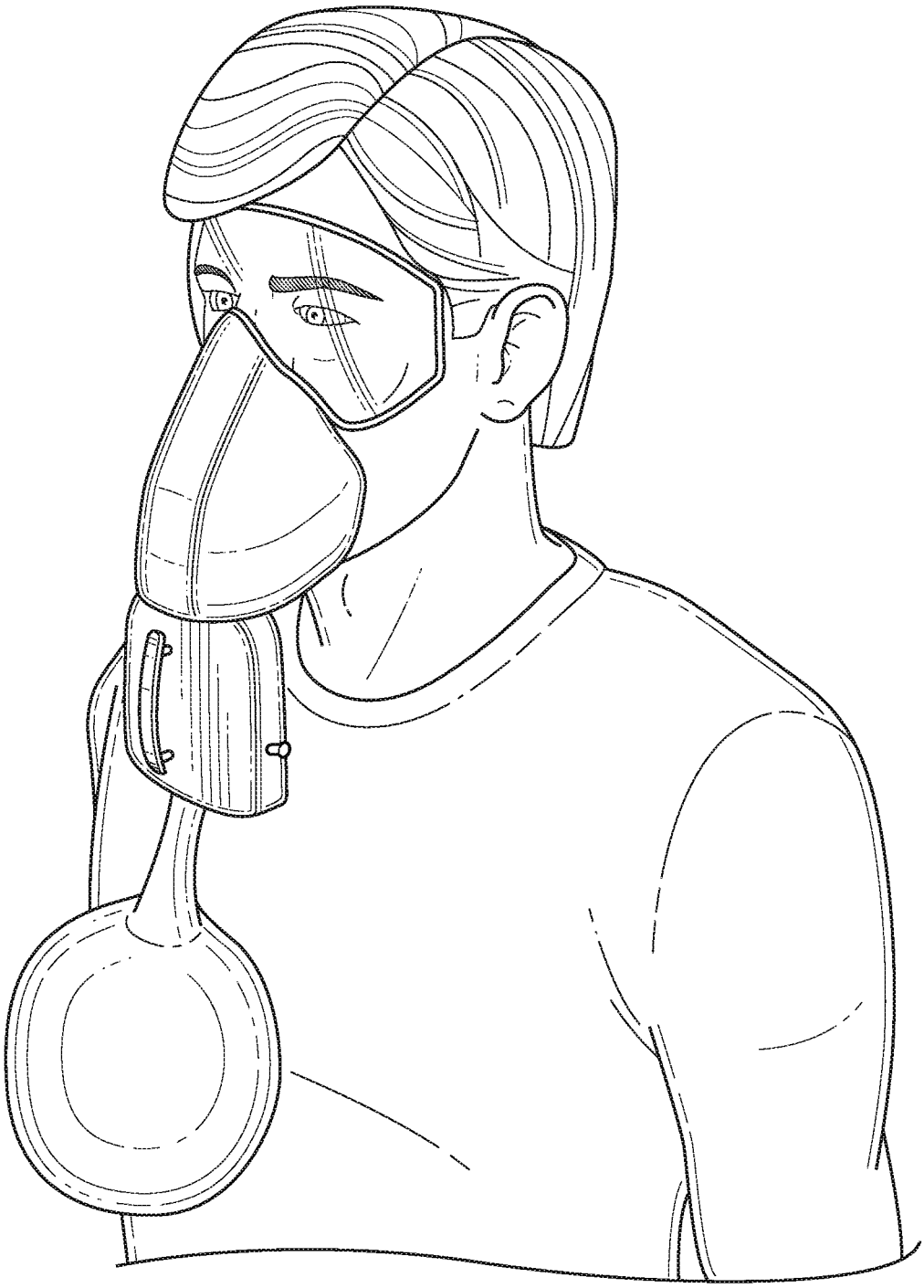
FIG. 12 depicts a front left perspective view of the ocular respiratory mask of the exemplary emergency air supply system, after inflation of the inflatable bag and removal of the ocular respiratory mask from the rearward housing body, after being applied to the face of the user.

Referring now to FIG. 12, there is depicted a front left perspective view of the ocular respiratory mask of the exemplary emergency air supply system, after inflation of the inflatable bag and removal of the ocular respiratory mask from the rearward housing body, after being applied to the face of the user. Generally, the ocular respiratory mask provides a snug or airtight fit to the face of the user, and a transparency of the transparent ocular cover allows the user to see as they escape the emergency.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. An emergency air supply system, comprising:

a system housing having a forward housing cover attached to a rearward housing body;

a left roller wheel track extending from a lower left portion of a rear surface of an interior of the rearward housing body in an upward and forward direction;

a right roller wheel track extending from a lower right portion of the rear surface of the interior of the rearward housing body in the upward and forward direction;

an ocular respiratory mask, removably disposed in the interior of the rearward housing body, having an inflatable bag fluidly connected to a mouthpiece of the ocular respiratory mask by a tube assembly of the ocular respiratory mask;

an air supply in actuatable fluid communication with the inflatable bag;

wherein the tube assembly includes an assembly housing having a left roller wheel disposed on a left surface of the assembly housing, and a right roller wheel disposed on a right surface of the assembly housing;

wherein a lower surface of the inflatable bag is flush with a lower surface of the interior of the rearward housing body, the left roller wheel is slidably disposed in the left roller wheel track, and the right roller wheel is slidably disposed in the right roller wheel track;

wherein an inflation of the inflatable bag by the air supply causes the inflatable bag to expand, thereby exerting a downward force from the lower surface of the inflatable bag to the lower surface of the interior of the rearward housing body, thereby sliding the left roller wheel upward and forward along the left roller wheel track, and sliding the right roller wheel upward and forward along the right roller wheel track, thereby configuring the ocular respiratory mask for removal from the system housing and use in an emergency, removal of the ocular respiratory mask thereby severing the actuatable fluid communication.

2. The emergency air supply system of claim 1, wherein the air supply includes an air tank, having a pressurized air therein, disposed in the interior of the rearward housing body.

3. The emergency air supply system of claim 1, wherein an air pressure of the air supply is measured and displayed by an air pressure gauge, operably connected to the air supply and viewable from an exterior of the system housing.

4. The emergency air supply system of claim 1, wherein the rearward housing body includes one or more wall mounts, configured to attach the system housing to a wall or another vertical structure for storage and use of the emergency air supply system.

5. The emergency air supply system of claim 1, wherein the forward housing cover includes a plurality of apertures in fluid communication with an exterior of the system housing, wherein the forward housing cover includes a smoke detector disposed on an interior surface of the forward housing cover.

6. The emergency air supply system of claim 5, wherein the forward housing cover includes a plurality of lights configured to illuminate upon a detection of an emergency.

7. The emergency air supply system of claim 6, wherein the detection of the emergency includes an actuation of the smoke detector.

8. The emergency air supply system of claim 1, wherein the ocular respiratory mask includes a transparent ocular cover, and a respiratory cover attached to a lower portion of the transparent ocular cover, wherein the tube assembly is attached to a lower portion of the respiratory cover and includes a handle on a forward surface of the tube assembly.

9. The emergency air supply system of claim 8, wherein the respiratory cover includes the mouthpiece, protruding from an inward surface of the respiratory cover, the mouthpiece having a mouthpiece tube in fluid communication with the inflatable bag.

10. The emergency air supply system of claim 1, wherein the actuatable fluid communication between the air supply and the inflatable bag includes an air supply valve assembly configured to direct a pressurized air of the air supply from the air supply to the inflatable bag upon a removal of an air supply valve assembly clip from the air supply valve assembly.

11. The emergency air supply system of claim 10, wherein the removal of the air supply valve assembly clip from the air supply valve assembly causes an upwardly biased cylindrical seal to slide upward, which directs the pressurized air of the air supply to a tube configured to direct the pressurized air from the air supply to the inflatable bag.

12. The emergency air supply system of claim 1, wherein an actuation of the actuatable fluid communication between the air supply and the inflatable bag directs a pressurized air of the air supply to the tube assembly, wherein the tube assembly directs the pressurized air to the inflatable bag.

13. The emergency air supply system of claim 12, wherein the pressurized air of the air supply overcomes a bias of a biased air flap of the tube assembly, wherein a movement of the biased air flap opens a fluid communication between the air supply and the inflatable bag, and closes a fluid communication between the inflatable bag and a mouthpiece tube of the tube assembly.

14. The emergency air supply system of claim 12, wherein after the pressurized air of the air supply is directed to the inflatable bag, and after the actuatable fluid communication between the air supply and the inflatable bag is severed, the tube assembly directs the pressurized air of the inflatable bag to the mouthpiece of the ocular respiratory mask.

15. The emergency air supply system of claim 14, wherein after the actuatable fluid communication between the air supply and the inflatable bag is severed, a bias of a biased air flap of the tube assembly overcomes an internal pressure of the tube assembly, wherein a movement of the biased air flap opens a fluid communication between the inflatable bag and a mouthpiece tube of the tube assembly, and closes a fluid communication between the inflatable bag and an exterior of the tube assembly revealed upon the actuatable fluid communication between the air supply and the inflatable bag being severed.

* * * * *